US008041247B2

(12) United States Patent
Yoshikawa

(10) Patent No.: US 8,041,247 B2
(45) Date of Patent: Oct. 18, 2011

(54) IMAGE FORMING APPARATUS, CONTROL METHOD OF THE SAME, RECORDING MEDIUM FOR THE SAME, AND IMAGE FORMING SYSTEM

(75) Inventor: Tatsuo Yoshikawa, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 145 days.

(21) Appl. No.: 12/640,556

(22) Filed: Dec. 17, 2009

(65) Prior Publication Data

US 2010/0226680 A1 Sep. 9, 2010

(30) Foreign Application Priority Data

Mar. 9, 2009 (JP) ..... 2009-055471
Oct. 29, 2009 (JP) ..... 2009-249005

(51) Int. Cl.
*G03G 15/00* (2006.01)

(52) U.S. Cl. ..... 399/82; 399/84; 399/382

(58) Field of Classification Search ..... 399/82, 399/84–86, 381, 382
See application file for complete search history.

(56) References Cited

U.S. PATENT DOCUMENTS 6,937,829 B2 * 8/2005 Sato et al. ..... 399/82
7,391,986 B2 * 6/2008 Ushio et al. ..... 399/84

FOREIGN PATENT DOCUMENTS

| | | |
|---|---|---|
| JP | 5-24735 | 2/1993 |
| JP | 11-344847 | 12/1999 |
| JP | 2005-67757 | 3/2005 |
| JP | 2006-1207 | 1/2006 |
| JP | 3805263 | 5/2006 |
| JP | 3848172 | 9/2006 |
| JP | 3852728 | 9/2006 |
| JP | 3962679 | 5/2007 |
| JP | 2007-172216 | 7/2007 |
| JP | 4095269 | 3/2008 |
| JP | 4218707 | 11/2008 |
| JP | 4313974 | 5/2009 |

* cited by examiner

*Primary Examiner* — Hoang Ngo
(74) *Attorney, Agent, or Firm* — Oblon, Spivak, McClelland, Maier & Neustadt, L.L.P.

(57) ABSTRACT

A disclosed image forming apparatus includes an image forming paper accommodating unit accommodating papers on which an image is formed, a specific paper accommodating unit accommodating specific papers, an image forming processing unit forming an image based on single-side or double-side image page data for papers, a sheet discharge unit to which the papers are discharged, and a control unit configured to control all the units, in which, when determining that the image forming job assigned to the specific papers accommodated in the specific paper accommodating unit is the double-side image forming job, the specific papers are fed from the specific paper accommodating unit based on the image page data assigned to a front side of the double-side image forming job and the image page data assigned to a rear side of the double-side image forming job are deleted.

7 Claims, 4 Drawing Sheets

IMAGE FORMING APPARATUS, CONTROL METHOD OF THE SAME, RECORDING MEDIUM FOR THE SAME, AND IMAGE FORMING SYSTEM

CROSS-REFERENCE TO RELATED APPLICATIONS

The present application claims priority under 35 U.S.C. §119 to Japanese Patent Application Publication Nos. 2009-055471, filed Mar. 9, 2009, and 2009-249005, filed Oct. 29, 2009, the entire contents of which are hereby incorporated herein by reference.

BACKGROUND OF THE INVENTION

1. Field of the Invention

The present invention generally relates to an image forming apparatus having a double-sided image forming function, an image forming system including the image forming apparatus, and a control method and a program to be used in the image forming apparatus.

2. Description of the Related Art

As an example of such an image forming apparatus, there has been known an image forming apparatus including a sheet feeding section accommodating normal printing papers having two sides (surfaces) on which an image can be formed and an interleaf insertion section in which interleaves (slip sheets) can be set. Herein, the interleaf set in the interleaf insertion section refers to a specific paper (such as a color sheet, an index sheet and the like) to be interleaved (inserted) between the printing papers in between, for example, different print jobs.

Japanese Patent Application Publication Nos. 1993(H05)-024735 and 1999(H11)-344847 disclose image forming apparatuses in which the interleaves set in the interleaf insertion section are supplied (fed) from the interleaf insertion section based on a print job and directly loaded to the sheet discharge section without being passed through any of the transfer section and the fixing section. As a result, the interleaves are discharged into the discharge tray with no image formed thereon.

Further, Japanese Patent Application Publication No. 2003-241915 discloses a configuration in which, as interleaf data generated by an upper-level apparatus to be used for the interleaf fed from the interleaf insertion section, there are provided one page of print layout page data, which are transmitted in addition to the print layout page data to be printed on normal printing papers.

Recently, there has been known a configuration of an image forming apparatus including plural sheet feeding trays in the sheet feeding section where the papers on which images are to be formed are set. In addition, there is a demand for printing an image on the interleaves based on the interleaf data, the interleaves being known as specific papers. To that end, there has been provided an image forming apparatus having a second sheet feeding tray in addition to a first sheet feeding tray so that the interleaves can be set in the second sheet feeding tray. By having this feature, it becomes possible to perform either single-side printing or double-side printing on the interleaves supplied (fed) from the second sheet feeding tray. On the other hand, the interleaves set in the interleaf insertion section cannot be printed but are fed (discharged) only.

In a double-side printing apparatus having the interleaf insertion section and plural sheet feeding trays, there may be a method in which the interleaves are set in the interleaf insertion section even in a normal printing operation. By doing this, a tray in the interleaf insertion section may serve as an alternative tray instead of the second sheet feeding tray. That is, in this case, the interleaves set in the tray of the interleaf insertion section can be supplied (discharged) instead of the interleaves set in the second sheet feeding tray once (after) the interleaves set in the second sheet feeding tray have been completely used up. In this double-side printing apparatus, a case is considered where an interleaf print data to be used for printing images on the interleaf set in the second sheet feeding tray are transmitted when there is no interleaf remained in the second sheet feeding tray. In this case, an interleaf set in the interleaf insertion section is fed and discharged with no image printed thereon based on the interleaf print data. As a result, no image is printed on any surface of the interleaf and the interleaf print data may be lost (without being used). However, this method has been practically used when, for example, it is desired to continue a print job to print images on the printing papers by using the interleaves set in the interleaf insertion section even when the interleaves set in the second sheet feeding tray have been completely used up. However, as described above, in a case where the print job is continued by using the interleaves set in the interleaf insertion section even when the interleaves set in the second sheet feeding tray have been completely used up, when a double-sided print job is being assigned to the interleaves set in the second sheet feeding tray, the double-sided print job is also assigned to the interleaves set in the interleaf insertion section. When the double-sided print job is assigned, two pages of page data corresponding to a data of the front and the rear surfaces are accordingly assigned to the interleaf set in the interleaf insertion section. To respond to this case, there is a disclosed method for a printing apparatus according to Japanese Patent Application Publication No. 2005-067757, in which a first interleaf is discharged based on the page data of the front surface of the double-sided print job and then a second interleaf is discharged based on the page data of the rear surface of the double-sided print job. However, when this method is applied, two interleaves are discharged based on the data of the front and the rear surfaces of the double-sided print job, which may indicate a problem that two interleaves are necessary to be discharged (used) even in a case where one interleaf is good enough.

SUMMARY OF THE INVENTION

The present invention is made in light of the above problem and may provide an image forming apparatus, an image forming system including the image forming apparatus, and a control method and a program to be used in the image forming apparatus, the image forming apparatus being capable of preventing plural specific papers from being discharged when a double-sided image forming print job is assigned to a specific paper having both sides (surfaces) on which no image data can be printed, the specific paper being set in a specific paper accommodating section.

According to a first aspect of the present invention, there is provided an image forming apparatus including:

an image forming paper accommodating unit accommodating papers having a single side or double sides on which an image is formed;

a specific paper accommodating unit accommodating specific papers;

an image forming processing unit performing an image forming operation based on single-side image page data or double-side image page data with respect to the papers fed from the image forming paper accommodating unit;

a sheet discharge unit to which the papers and the specific papers are discharged; and a control unit controlling all the units.

Further in the image forming apparatus, the control unit determines whether an image forming job assigned to the specific papers accommodated in the sheet discharge unit is a double-side image forming job, when determining that the image forming job assigned to the specific papers accommodated in the specific paper accommodating unit is the double-side image forming job, the control unit controls so that the specific papers are fed from the specific paper accommodating unit based on the image page data assigned to a front side of the double-side image forming job and are discharged to the sheet discharge unit, and the control unit further controls so that the image page data assigned to a rear side of the double-side image forming job are deleted.

According to a second aspect of the present invention, the image forming apparatus according to the first aspect further includes an additional image forming paper accommodating unit, wherein the specific papers are accommodated in any of the image forming paper accommodating units, and when all the specific papers accommodated in any of the plural image forming paper accommodating units are completely used up, the control unit controls so that the image forming job assigned to the specific papers is assigned to the specific papers accommodated in the specific paper accommodating unit.

According to a third aspect of the present invention, in the image forming apparatus according to the first or the second aspect, the specific papers are interleaves to be inserted between the papers on which an image is formed.

According to a fourth aspect of the present invention, the image forming apparatus according to any one of the first through the third aspects further includes:

a job instruction receiving unit receiving an instruction of the double-side image forming job from an external information processing apparatus, in which the job instruction receiving unit receives the instruction of the double-side image forming job to be assigned to the specific papers.

According to a fifth aspect of the present invention, there is provided an image forming system including:

the image forming apparatus according to the fourth aspect; and the external information processing apparatus configured to transmit the instruction of the image forming job to the image forming apparatus.

According to a sixth aspect of the present invention, there is provided a control method for an image forming apparatus including:

an image forming paper accommodating unit accommodating papers having a single side or double sides on which an image is formed, a specific paper accommodating unit accommodating specific papers, an image forming processing unit performing an image forming operation based on single-side image page data or double-side image page data with respect to the papers fed from the image forming paper accommodating unit, and a sheet discharge unit to which the papers and the specific papers are discharged. Further, the control method includes:

a determining step of determining whether an image forming job assigned to the specific papers accommodated in the specific paper accommodating unit is a double-side image forming job; and a control step of, when determining that the image forming job assigned to the specific papers accommodated in the specific paper accommodating unit is the double-side image forming job, feeding the specific papers from the specific paper accommodating unit based on the image page data assigned to a front side of the double-side image forming job, discharging the specific papers to the sheet discharge unit, and deleting the image page data assigned to a rear side of the double-side image forming job.

According to a seventh aspect of the present invention, there is provided a recording medium having a program readable and executable by a control unit of an image forming apparatus including:

an image forming paper accommodating unit accommodating papers having a single side or double sides on which an image is formed, a specific paper accommodating unit accommodating specific papers, an image forming processing unit performing an image forming operation based on single-side image page data or double-side image page data with respect to the papers fed from the image forming paper accommodating unit, and a sheet discharge unit to which the papers and the specific papers are discharged. Further, the program causing the image forming apparatus to execute a method includes:

a determining step of determining whether an image forming job assigned to the specific papers accommodated in the specific paper accommodating unit is a double-side image forming job; and a control step of, when determining that the image forming job assigned to the specific papers accommodated in the specific paper accommodating unit is the double-side image forming job, feeding the specific papers from the specific paper accommodating unit based on the image page data assigned to a front side of the double-side image forming job, discharging the specific papers to the sheet discharge unit, and deleting the image page data assigned to a rear side of the double-side image forming job.

According to an embodiment of the present invention, in a case where a specific paper is accommodated (set) in the specific paper accommodating section, when determining that an image forming job (print job) assigned to the specific paper is a double-sided image forming job (that is, double-sided print job), only the image page data related to the front surface of the double-sided print job is actually printed on a surface of the specific paper fed from the specific paper accommodating section to be discharged into a sheet discharge section. In this case, the image page data related to the rear surface of the double-sided print job is destroyed (deleted). By doing this, when the double-sided image forming job (double-sided print job) is assigned to the specific paper, it may become possible to prevent plural specific papers from continuously discharged.

BRIEF DESCRIPTION OF THE DRAWINGS

Other objects, features, and advantages of the present invention will become more apparent from the following descriptions when read in conjunction with the accompanying drawings, in which.

DETAILED DESCRIPTION OF THE PREFERRED EMBODIMENTS

In the following, a preferred embodiment of the present invention is described with reference to the accompanying drawings.

Figure 1:
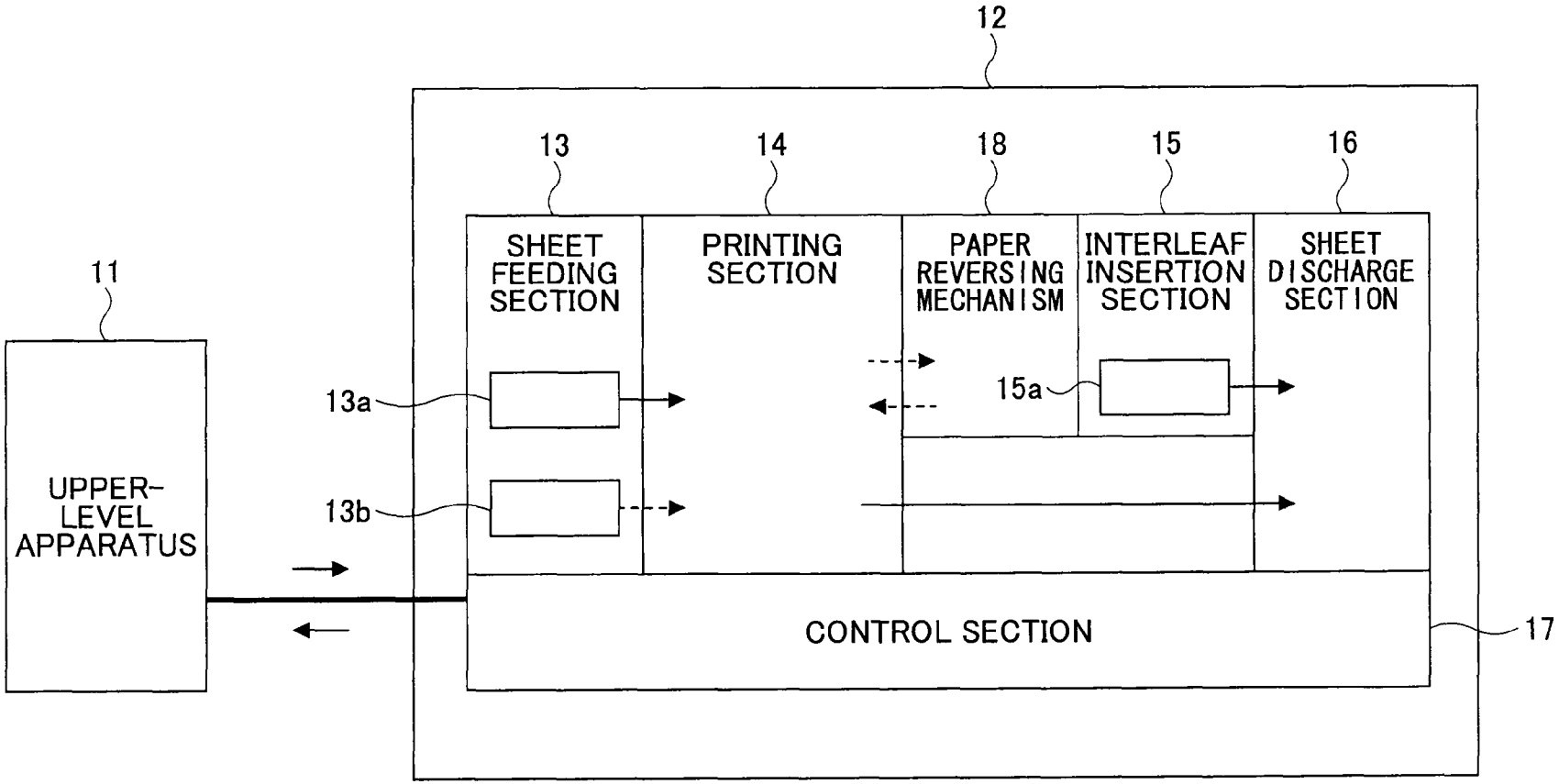
FIG. 1 is a block diagram showing an exemplary schematic configuration of an image forming system according to an embodiment of the present invention.

FIG. 1 is a block diagram showing an exemplary schematic configuration of an image forming system according to an embodiment of the present invention. As shown in FIG. 1, the image forming system includes an upper-level apparatus 11 and a printing apparatus 12 serving as an image forming apparatus. The upper-level apparatus 11 typically includes a computer serving as an apparatus capable of processing external data. The upper-level apparatus 11 is connected to the printing apparatus 12 so that bidirectional communications can take place between the upper-level apparatus 11 and the printing apparatus 12. The upper-level apparatus 11 is provided so as to transmit an image forming job (hereinafter may be referred to as a print job) to the printing apparatus 12. Further, as shown in FIG. 1, the printing apparatus 12 includes a sheet feeding section 13, a printing section 14 printing an image on a printing paper based on the print job, an interleaf insertion section 15, a sheet discharge section 16 discharging the printing paper, a control section 17, and a paper reversing mechanism 18. The control section 17 of the printing apparatus 12 receives the print job from the upper-level apparatus 11. Then, the control section 17 transmits control instructions to the sheet feeding section 13, the printing section 14, the interleaf insertion section 15, the sheet discharge section 16, and the paper reversing mechanism 18 so as to achieve printing by forming a print image on a predetermined paper.

The sheet feeding section 13 includes a first sheet feeding tray 13*a* and a second sheet feeding tray 13*b* so that the sheet feeding section 13 has (provides) plural paper accommodating sections capable of accommodating printing papers on which images are to be formed. In this embodiment of the present invention, there are provided two sheet feeding trays 13*a* and 13*b* as the plural paper accommodating sections. However, the present invention is not limited to this configuration. Namely, the number of the sheet feeding sections 13 may be three or more. The sheet feeding section 13 takes out a printing paper from the first sheet feeding tray 13*a* or the second sheet feeding tray 13*b* accommodating printing papers and feeds the printing paper to the printing section 14. The printing section 14 is capable of printing an image data on either the front or the rear surface of the printing paper fed from the first sheet feeding tray 13*a* or the second sheet feeding tray 13*b* of the sheet feeding section 13.

The interleaf insertion section 15 includes an interleaf tray 15*a* serving as a specific paper accommodating section accommodating interleaves as the specific papers. The interleaf insertion section 15 takes out an interleaf (a slip sheet) from the interleaf tray 15*a* and directly feeds (discharges) the interleaf to the sheet discharge section 16. Because of this structure, it is not possible to print an image data on the interleaf taken out from the interleaf tray 15*a*. Herein, the interleaf is a specific paper (such as a color sheet, an index sheet and the like) to be interleaved (inserted) in between normal printing papers.

The printing section 14 includes a print engine (not shown) enabling to perform, for example, an electrophotographic image forming process. By using the print engine, the printing section 14 transfers an image onto the printing paper fed from the sheet feeding section 13, the image corresponding to an image page data received from the control section 17. Then, the printing section 14 feeds the printing paper on which the image is transferred to the sheet discharge section 16. Further, when a double-sided print job is assigned to the printing paper, the printing section 14 performs a double-side printing. In the double-side printing, for example, the printing section 14 prints an image on one (front) surface of the printing paper and then feeds the printing paper to the paper reversing mechanism 18. The paper reversing mechanism 18 reverses the printing paper and feeds the reversed printed paper back to the printing section 14. Then, the printing section 14 prints another image on the other (rear) surface of the printing paper.

The sheet discharge section 16 discharges the printing paper into a discharge tray, the printing paper having been printed in the printing section 14. Then, the sheet discharge section 16 reports the completion of the discharge to the control section 17. Further, the sheet discharge section 16 discharges the interleaf having no image formed thereon into the discharge tray. Then, the sheet discharge section 16 reports the completion of the discharge to the control section 17.

The control section 17 controls each of the above sections and mechanism and reports the completion of printing one page of the printing paper to the upper-level apparatus 11. By determining a predetermined number of printed pages based on the report(s), the upper-level apparatus 11 recognizes the completion of the corresponding print job.

The paper reversing mechanism 18 includes, for example, a paper feeding roller, a paper feeding guide, and a switch-back mechanism (each not shown). Upon receiving the double-sided print job from the upper-level apparatus 11, the paper reversing mechanism 18 is controlled by the control section 17, so that the paper reversing mechanism 18 receives the printing paper on which the image is formed on one (front) surface of the printing paper from the printing section 14, reverses the paper between the front and the rear surfaces thereof, and feeds the reversed printing paper back to the printing section 14. By doing this, it becomes possible to print images on both surfaces of the printing paper.

Further, the feed of the printing paper from the sheet feeding section 13 to the printing section 14, the feed of the printing paper between the printing section 14 and the paper reversing mechanism 18, the feed of the printing paper from the printing section 14 to the sheet discharge section 16, and the feed of the printing paper from the interleaf insertion section 15 to the sheet discharge section 16 can be performed by using respective paper feeding means including paper feeding rollers (not shown), paper feeding guides (not shown) serving as paper feeding path forming members and the like each provided at corresponding predetermined positions.

Figure 2:
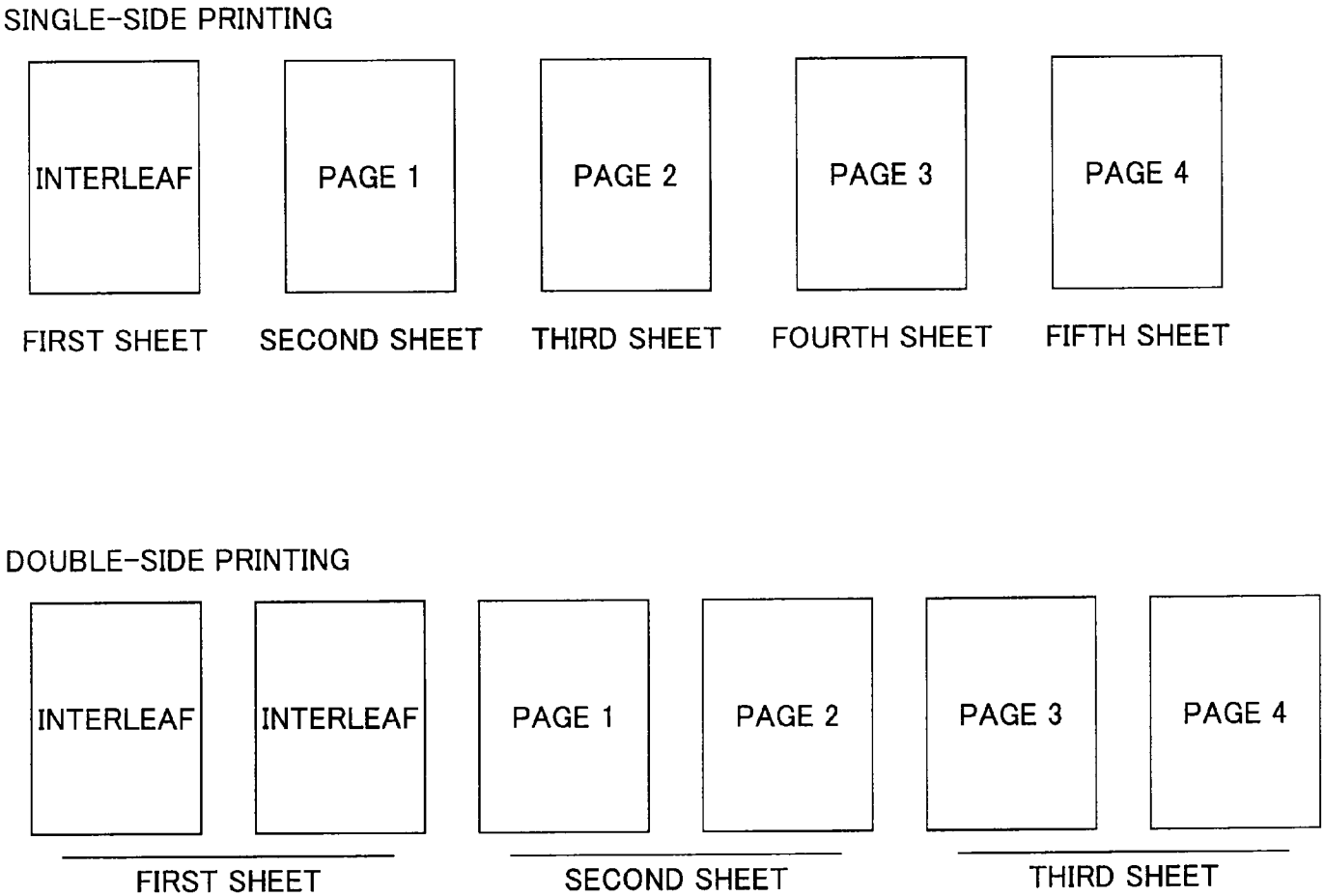
FIG. 2 is a drawing showing exemplary configurations of print jobs used in a printing apparatus (serving as an image forming apparatus) of the image forming system in FIG. 1.

FIG. 2 shows exemplary configurations of print jobs used in the printing apparatus (serving as an image forming apparatus) according to an embodiment of the present invention. Each print job includes print data including information items such as an item indicating an image page data (such as characters and figures) to be printed and control information items such as an item indicating a type of the print job whether single-side printing or double-side printing is to be performed and an item indicating which tray is to be used.

When the type of the print job is the single-side printing (hereinafter may be referred to as single-side printing job), the print data including one page of the image page data are assigned to a single printing paper.

On the other hand, when the type of the print job is the double-side printing (hereinafter may be referred to as double-side printing job), the print data including two pages (a first page and a second page) of the image page data are assigned to a single printing paper. The image page data of the first page of the two pages correspond to an image for the front surface of the printing paper. On the other hand, the image data of the second page of the two pages correspond to an image for the rear surface of the printing paper. Further, similar to the single-side printing job, in the case of the double-side printing job, the print data may be assigned to the interleaf as well. However, in this case, the print data including two pages of image page data are assigned to the interleaf unlike the case of the single-side printing job.

In the printing apparatus 12 according to this embodiment of the present invention, it doesn't matter whether a tray in which the interleaves are to be set is the second sheet feeding tray 13*b* of the sheet feeding section 13 or the interleaf tray 15*a* of the interleaf insertion section 15. However, the printing papers are required to be set not in the interleaf tray 15*a* but in the first sheet feeding tray 13*a* and, when necessary, the second sheet feeding tray 13*b*. This is because, when the printing papers are set in the interleaf tray 15*a*, the printing papers are directly discharged to the sheet discharge section 16 without being passed through any of a transfer section and a fixing section in the printing section 14.

Further, the printing apparatus 12 according to this embodiment of the present invention may be used for the purpose of printing an image on an index part of the index sheet serving as the interleaf. To achieve that purpose, in a normal operation, the interleaves are set in the second sheet feeding tray 13*b* of the sheet feeding section 13 so that the interleaves can be printed. On the other hand, when the interleaves are set in the interleaf tray 15*a* of the interleaf insertion section 15, the interleaves cannot be printed but can be fed (discharged) only. In this case, in order to feed the interleaves from the interleaf tray 15*a*, it is required to provide a dummy page data (having one page of data).

Further, as another use of the printing apparatus 12 according to this embodiment of the present invention, the interleaves may be previously set in the interleaf tray 15*a* of the interleaf insertion section 15 in addition to the second sheet feeding tray 13*b* of the sheet feeding section 13. By doing this, it may become possible to use the interleaves in the interleaf tray 15*a* when all the interleaves in the second sheet feeding tray 13*b* are completely used up, thereby enabling continuation of the printing operation. In this case, it may be true that, when there are print data to be printed on the interleaves, the print data are no longer printed on the interleaves (discharged from the interleaf tray in a case where, for example, a priority is to be placed on continuing the printing operation, the printing operation may be continued by using the interleaves set in the interleaf tray 15*a*. In this embodiment of the preset invention, a priority order is set as follows: the first (higher) priority is set to the second sheet feeding tray 13*b* of the sheet feeding section 13 and the second (lower) priority is set to the interleaf tray 15*a* of the interleaf insertion section 15.

Further, in the printing apparatus 12 according to this embodiment of the present invention, there is further provided a detection section (not shown) capable of detecting a type of a paper (interleaf) set at least in the second sheet feeding tray 13*b*. By having the detection section, the printing apparatus 12 may determine (ensure) whether adequate interleaves are set in the second sheet feeding tray 13*b* of the sheet feeding section 13. More specifically, in this embodiment of the present invention, there is provided the detection section detecting the size of the papers set in the second sheet feeding tray 13*b*. By using the detection section, based on predetermined paper-type data, it may become possible to determine whether the paper set in the second sheet feeding tray 13*b* is the interleaf. Instead of including the detection section, the printing apparatus 12 may include a print media type detection sensor detecting a type of print media (printing paper). Further, the printing apparatus 12 may further include the print media type detection sensor(s) at the first sheet feeding tray 13*a* of the sheet feeding section 13 and/or the interleaf tray 15*a* of the interleaf insertion section 15.

Figure 3:
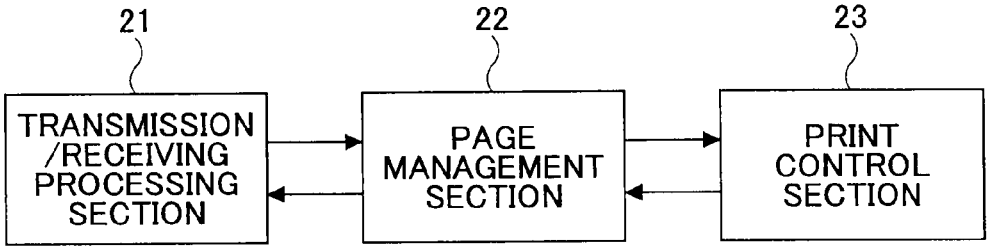
FIG. 3 is a block diagram showing an exemplary structure of a program executed in a control section integrally controlling the image forming apparatus of FIG. 1.

FIG. 3 is a block diagram showing an exemplary structure of a program executed in the control section 17 integrally controlling the printing apparatus 12 according to this embodiment of the present invention. As shown in FIG. 3, the program includes a transmission/receiving processing section 21, a page management section 22, and a print control section 23. The transmission/receiving processing section 21 receives the print job from the upper-level apparatus 11, generates (derives) the print data including the image page data based on the received print job, and transmits the generated print data to the page management section 22. The program to be executed in the control section 17 is stored in a predetermined memory medium such as a semiconductor memory (RAM or ROM) in the control section 17 and loaded on an as-needed basis to be executed.

In the single-side printing job, the page management section 22 holds the print data including one page of the image page data. On the other hand, in the double-side printing job, the page management section 22 holds the print data including two pages of the image page data as bundled data.

In a case where the printing papers or interleaves set in the sheet feeding trays 13*a* and 13*b* are to be printed, the page management section 22 transmits the print data to the print control section 23 in a manner as follows. For example, in the single-side printing job, the page management section 22 transmits the print data including one page of the image page data to the print control section 23. On the other hand, in the double-side printing job, the page management section 22 transmits the print data at one time including two pages of the image page data to the print control section 23.

On the other hand, there is another case of an interleaf insertion process where the interleaves set in the interleaf tray 15*a* of the interleaf insertion section 15 are fed (discharged) to the sheet discharge section 16 (i.e., when an interleaf is fed from the interleaf insertion section 15). In this case, the page management section 22 transmits the print data to the print control section 23 in a manner as follows. For example, in the single-side printing job, similar to the case described above, the page management section 22 transmits the print data including one page of the image page data to the print control section 23. On the other hand, in the double-side printing job, the page management section 22 designates the single-side printing and then transmits the print data including only one page of the image page data to the print control section 23. As a result, the page management section 22 destroys (deletes) the print data of the other (remained) page of the image page data. Further, the process performed on the print data by the page management section 22 as described above is similarly performed in the following case as well: when there is no interleaf left in the second sheet feeding tray 13*b* of the sheet feeding section 13, either the single-side printing job or the double-side printing job originally assigned to the interleaves set in the second sheet feeding tray 13*b* are changed to be assigned to the interleaves set in the interleaf tray 15*a* of the interleaf insertion section 15.

The print control section 23 transmits the print data received from the page management section 22 to the printing section 14 at a timing when a print hardware requests to receive the print data. After one page or two pages of image data are printed in the single-side printing job or the double-side printing job, respectively, and the printed paper is discharged into a discharge tray of the sheet discharge section 16, the print control section 23 reports the completion of the printing one page of the printing paper to the page management section 22.

On the other hand, in the interleaf insertion process where the interleaves set in the interleaf tray 15*a* of the interleaf insertion section 15 are discharged to the sheet discharge section 16, the print control section 23 controls to cause the interleaf insertion section 15 to discharge the interleaf to the sheet discharge section 16 based on the print data received from the page management section 22 regardless of whether it is in the single-side printing job or in the double-side printing job. When the interleaf is discharged to the discharge tray of the sheet discharge section 16, the print control section 23 reports the completion of the printing one page of the printing paper (completion of the interleaf insertion) to the page management section 22. By controlling the printing process in this way, it may become possible to avoid the interruption of the print job due to no interleaf left in the second sheet feeding tray 13*b* when the single-side printing job or the double-side printing job is assigned to the interleaves set in the second sheet feeding tray 13*b* of the sheet feeding section 13. As a result, it may become possible to continue the print job received from the upper-level apparatus 11 until the job completes (to the end). In this case, when there are print data of an image to be printed on the interleaves, the print data are deleted with no image being formed on the interleaves. However, the priority can be placed on the continuity of the print job and as a result, the interleaves may be inserted at predetermined locations in between the printing papers discharged in the sheet discharge section 16.

The page management section 22 reports the completion of the printing one page of the printing paper to the upper-level apparatus 11 via the transmission/receiving processing section 21. This report is performed regardless of the number of pages of the print data actually transmitted to the print control section 23. That is, in the single-side printing, the page management section 22 reports the completion of the printing with respect to one page; and in the double-side printing, the page management section 22 reports the completion of the printing with respect to two pages at one time.

Figure 4:
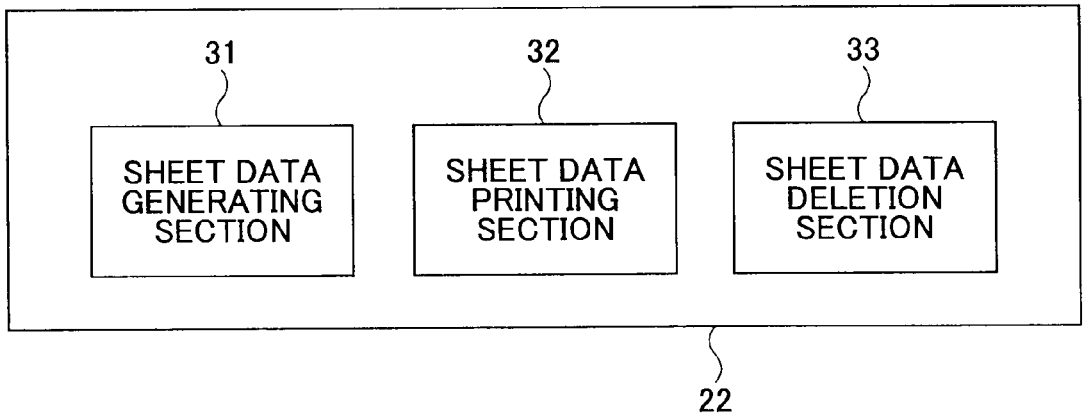
FIG. 4 is a block diagram showing an exemplary configuration of a page management section serving as an element of the program shown in FIG. 3.

FIG. 4 is a block diagram showing an exemplary configuration of the page management section 22. As shown in FIG. 4, the page management section 22 includes a sheet data generating section 31, a sheet data printing section 32, and a sheet data deletion section 33. The sheet data generating section 31 manages the print data received from the transmission/receiving processing section 21 in a manner as follows. For example, in the single-side printing job, the sheet data generating section 31 manages the print data by treating one page of image page data as bundled data; and in the double-side printing job, the print data by treating two pages of image page data as bundled data. Herein, the bundled data of the image page data may be called "sheet data".

The sheet data printing section 32 periodically operates to detect (determine) the status of the print control section 23. When determining that the print control section 23 is able to receive new sheet data, the sheet data printing section 32 transmits the new sheet data to the print control section 23.

Upon receiving the report of the completion of printing, the sheet data deletion section 33 reports the completion of printing to the upper-level apparatus 11 and deletes the sheet data corresponding to the report of the completion of printing.

Figure 5:
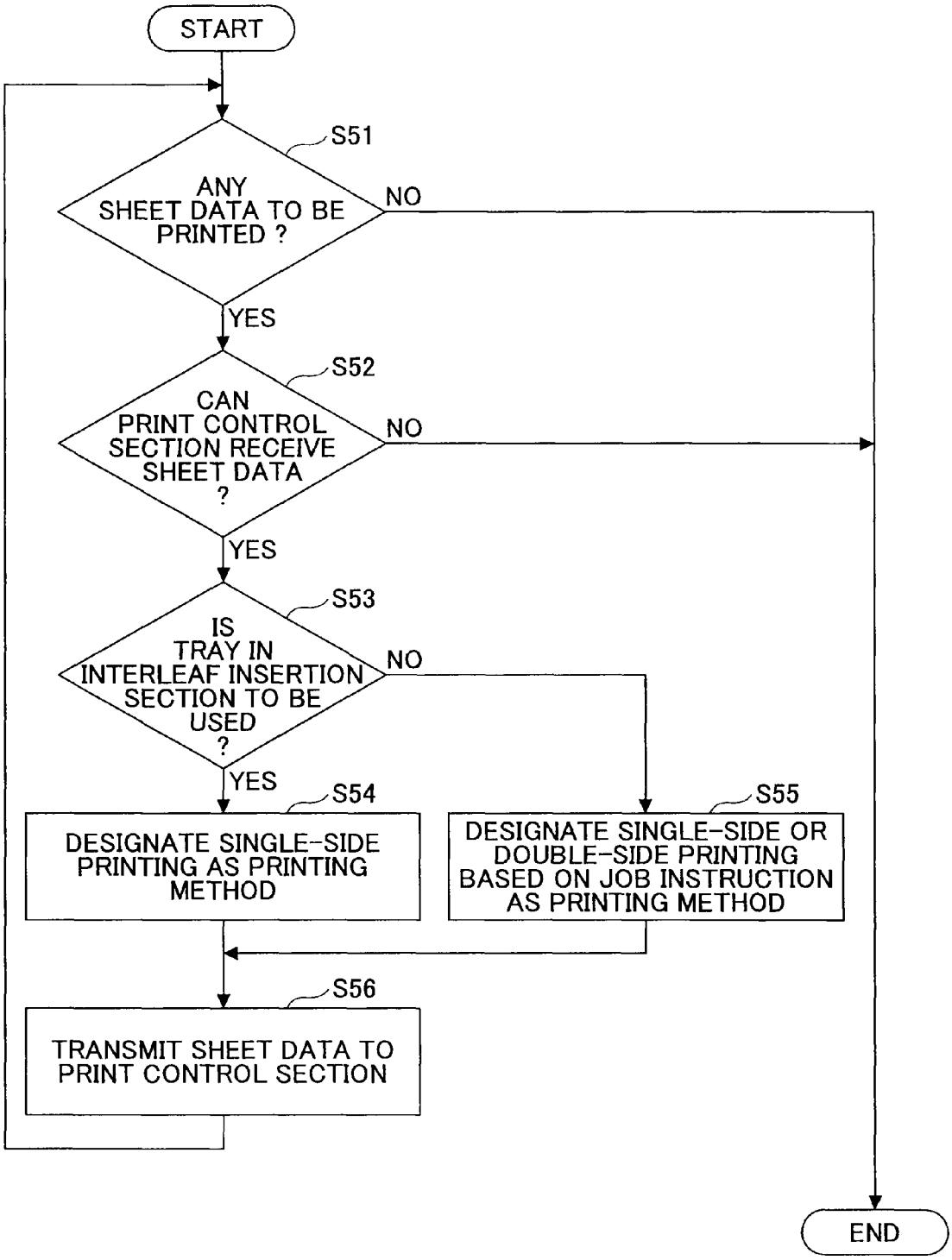
FIG. 5 is a flowchart showing an exemplary process executed in a sheet data printing section of the page management section shown in FIG. 4.

FIG. 5 is a flowchart showing an exemplary process executed in the sheet data printing section 32. As shown in FIG. 5, in step S51, it is determined whether there is sheet data having been generated in the sheet data generating section 31 but not having been transmitted to the print control section 23. When YES in step S51, the process goes to step S52.

In step S52, it is determined whether the print control section 23 is able to process (receive) a new sheet data. When YES in step S52, the process goes to step S53.

In step S53, it is determined whether the sheet data to be printed are assigned to a paper (typically an interleaf) set in the interleaf tray 15*a* of the interleaf insertion section 15. When YES in step S53, the process goes to step S54.

In step S54, the sheet data printing section 32 designates the single-side printing to report the single-side printing to the print control section 23. In this case, this designation is to be applied (reported) to the print control section 23 only. By doing this, that is, by designating (reporting) the single-side printing only to the print control section 23, it may become possible to prevent inconsistency in print data (i.e., whether the print data is for single-side printing or double-side printing) transmitted back and forth between the printing apparatus 12 and the upper-level apparatus 11.

More specifically, in a case where the upper-level apparatus 11 designates that the double-side printing is assigned to the interleaves, even when only the single-side printing is actually performed, the printing apparatus 12 reports that the double-side printing has been performed to the upper-level apparatus 11. By doing in this way, the upper-level apparatus 11 can recognize that the print job in accordance with the designation by the upper-level apparatus 11 has been correctly performed by the printing apparatus 12.

Then, in step S56, the sheet data are transmitted to the print control section 23.

On the other hand, in step S51, when the printing has been completed and there is no further data sheet to be printed (NO in step S51) or in step S52, when the print control section 23 cannot process (receive) a new sheet data (NO in step S52), the process ends.

Further, the process in FIG. 5 is adequately repeated every predetermined period of time.

According to this embodiment of the present invention, a case is described where the interleaves as specific papers are accommodated (set) in the interleaf tray 15*a* of the interleaf insertion section 15 and it is determined whether the print job (image forming job) assigned to the interleaves is the double-side printing job (double-side image forming job). Further, in this case, when determining that the print job (image forming job) assigned to the interleaves is the double-side printing job (double-side image forming job), the image page data corresponding to the front surface of the interleaf are printed (processed) on the interleaves discharged from the interleaf tray 15*a* of the interleaf insertion section 15 into the discharge tray of the of the sheet discharge section 16, the image page data included in the double-side printing job (double-side image forming job). Further, in this case, the image page data corresponding to the rear surface of the interleaf are deleted by the print control section 23. By doing in this way, it may become possible to prevent plural interleaves from being continuously discharged when the double-side printing job is assigned to the interleaves accommodated (set) in the interleaf tray 15*a* of the interleaf insertion section 15 and the interleaves are fed (discharged) from the interleaf tray 15*a* of the interleaf insertion section 15.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teachings herein set forth.

What is claimed is:

1. An image forming apparatus comprising:

an image forming paper accommodating unit configured to accommodate papers having a single side or double sides on which an image is formed;

a specific paper accommodating unit configured to accommodate specific papers;

an image forming processing unit configured to perform an image forming operation based on single-side image page data or double-side image page data with respect to the papers fed from the image forming paper accommodating unit;

a sheet discharge unit to which the papers and the specific papers are discharged; and a control unit configured to control all the units, wherein the control unit determines whether an image forming job assigned to the specific papers accommodated in the specific paper accommodating unit is a double-side image forming job, when determining that the image forming job assigned to the specific papers accommodated in the specific paper accommodating unit is the double-side image forming job, the control unit controls so that the specific papers are fed from the specific paper accommodating unit based on the image page data assigned to a front side of the double-side image forming job and are discharged to the sheet discharge unit, and the control unit further controls so that the image page data assigned to a rear side of the double-side image forming job are deleted.

2. The image forming apparatus according to claim 1, further comprising:

an additional image forming paper accommodating unit, wherein the specific papers are accommodated in any of the image forming paper accommodating units, and when all the specific papers accommodated in any of the image forming paper accommodating units are completely used up, the control unit controls so that the image forming job assigned to the specific papers is assigned to the specific papers accommodated in the specific paper accommodating unit.

3. The image forming apparatus according to claim 1, wherein the specific papers are interleaves to be inserted between the papers on which an image is formed.

4. The image forming apparatus according to claim 1, further comprising:

a job instruction receiving unit configured to receive an instruction of the double-side image forming job from an external information processing apparatus, wherein the job instruction receiving unit receives the instruction of the double-side image forming job to be assigned to the specific papers.

5. An image forming system comprising:

the image forming apparatus according to claim 4; and the external information processing apparatus configured to transmit the instruction of the image forming job to the image forming apparatus.

6. A control method for an image forming apparatus including:

an image forming paper accommodating unit configured to accommodate papers having a single side or double sides on which an image is formed, a specific paper accommodating unit configured to accommodate specific papers, an image forming processing unit configured to perform an image forming operation based on single-side image page data or double-side image page data with respect to the papers fed from the image forming paper accommodating unit, and a sheet discharge unit to which the papers and the specific papers are discharged, the control method comprising:

a determining step of determining whether an image forming job assigned to the specific papers accommodated in the specific paper accommodating unit is a double-side image forming job; and a control step of, when determining that the image forming job assigned to the specific papers accommodated in the specific paper accommodating unit is the double-side image forming job, feeding the specific papers from the specific paper accommodating unit based on the image page data assigned to a front side of the double-side image forming job, discharging the specific papers to the sheet discharge unit, and deleting the image page data assigned to a rear side of the double-side image forming job.

7. A recording medium having a program readable and executable by a control unit of an image forming apparatus including:

an image forming paper accommodating unit configured to accommodate papers having a single side or double sides on which an image is formed, a specific paper accommodating unit configured to accommodate specific papers, an image forming processing unit configured to perform an image forming operation based on single-side image page data or double-side image page data with respect to the papers fed from the image forming paper accommodating unit, and a sheet discharge unit to which the papers and the specific papers are discharged, the program causing the image forming apparatus to execute a method comprising:

a determining step of determining whether an image forming job assigned to the specific papers accommodated in the specific paper accommodating unit is a double-side image forming job; and a control step of, when determining that the image forming job assigned to the specific papers accommodated in the specific paper accommodating unit is the double-side image forming job, feeding the specific papers from the specific paper accommodating unit based on the image page data assigned to a front side of the double-side image forming job, discharging the specific papers to the sheet discharge unit, and deleting the image page data assigned to a rear side of the double-side image forming job.

* * * * *